United States Patent [19]

Hindle

[11] Patent Number: 4,899,476

[45] Date of Patent: Feb. 13, 1990

[54] REVERSIBLE MAGAZINE CATCH MECHANISM FOR HANDGUNS

[75] Inventor: Kurt J. Hindle, South Hadley, Mass.

[73] Assignee: Smith & Wesson Corp., Springfield, Mass.

[21] Appl. No.: 360,854

[22] Filed: Jun. 2, 1989

[51] Int. Cl.[4] ..... F41C 25/06

[52] U.S. Cl. ..... 42/7

[58] Field of Search ..... 42/7

[56] References Cited

U.S. PATENT DOCUMENTS

| | | | |
|---|---|---|---|
| 4,236,337 | 12/1980 | Beretta | 42/7 |
| 4,449,311 | 5/1984 | Giragosian | 42/7 |
| 4,539,770 | 9/1985 | Bornancini | 42/7 |
| 4,599,818 | 7/1986 | Fedora et al. | 42/7 |
| 4,768,301 | 9/1988 | Thomas | 42/7 |

*Primary Examiner*—Charles T. Jordan

*Attorney, Agent, or Firm*—Chapin, Neal & Dempsey

[57] ABSTRACT

A reversible magazine catch mechanism for handguns includes a knurled actuator button removably screw-fitted onto a shaft which is disposed for slidable axial movement in a bore which extends laterally through the frame of the gun. An enlarged head portion is disposed on the end of said shaft opposite the actuator button and an arm extends radially from the head for interlocking engagement with cutouts provided in opposite sides of the magazine. A spring-biased detent engages a recess in the undersurface of the actuator button to prevent unscrewing of the button from the shaft and to bias the latch arm of the laterally movable shaft into engagement with one of the magazine cutouts. Detent receiving sockets are disposed parallel to and adjacent the bore and open in opposite directions for reversal of the detent when the catch mechanism is reversed by unscrewing the actuator button from the shaft to reverse the same in the bore from one side of the gun frame to the other side for accommodating both right and left-handed shooters.

5 Claims, 2 Drawing Sheets

REVERSIBLE MAGAZINE CATCH MECHANISM FOR HANDGUNS

BACKGROUND OF THE INVENTION

This invention is directed toward a magazine catch mechanism for handguns which is easily reversible from one side to the other of the gun to accommodate both right and left-handed shooters.

U.S. Pat. No. 4,236,337 to Beretta discloses a reversible sliding magazine catch having a complex slidable latch mechanism which includes a housing 7, a pair of pistons and cavity of special countour. The entire mechanism has to be reversed within the frame when the pistol is being changed to accommodate left-handed shooters.

U.S. Pat. No. 4,449,311 to Giragosian shows a reversible magazine latch system in which the button 56 is axially separated from the spring 58 and several parts of the frame have to be relocated each time the latch assembly is reversed.

Bornancini, U.S. Pat. No. 4,539,770, shows a reversible magazine latch and spring assembly which is mounted within a guide tube. The tube is reversible within the frame and is a separate element therefrom.

The principal object of this invention is to provide a reversible latch mechanism for handguns of simple and economical construction in which the frame of the handgun requires no special or complex adaptations, tools, parts or fittings.

Another object of this invention is to provide a magazine catch and release mechanism which can be readily switched between right and left-handed shooting positions without any special tools.

Still another object of this invention is to provide a catch and release mechanism which requires no special contouring of the handgun frame and can be adapted to receive the catch mechanism by drilling cylindrical holes and providing simple cutouts in the frame.

A further object of this invention is to provide a catch and release mechanism which will not disassemble unless the user intentionally depresses a spring-biased detent to permit such disassembly for reversal of the catch mechanism.

The above and other objects and advantages of this invention will be more readily apparent from the following description read in conjunction with the accompanying drawings, in which.

Figure 1:
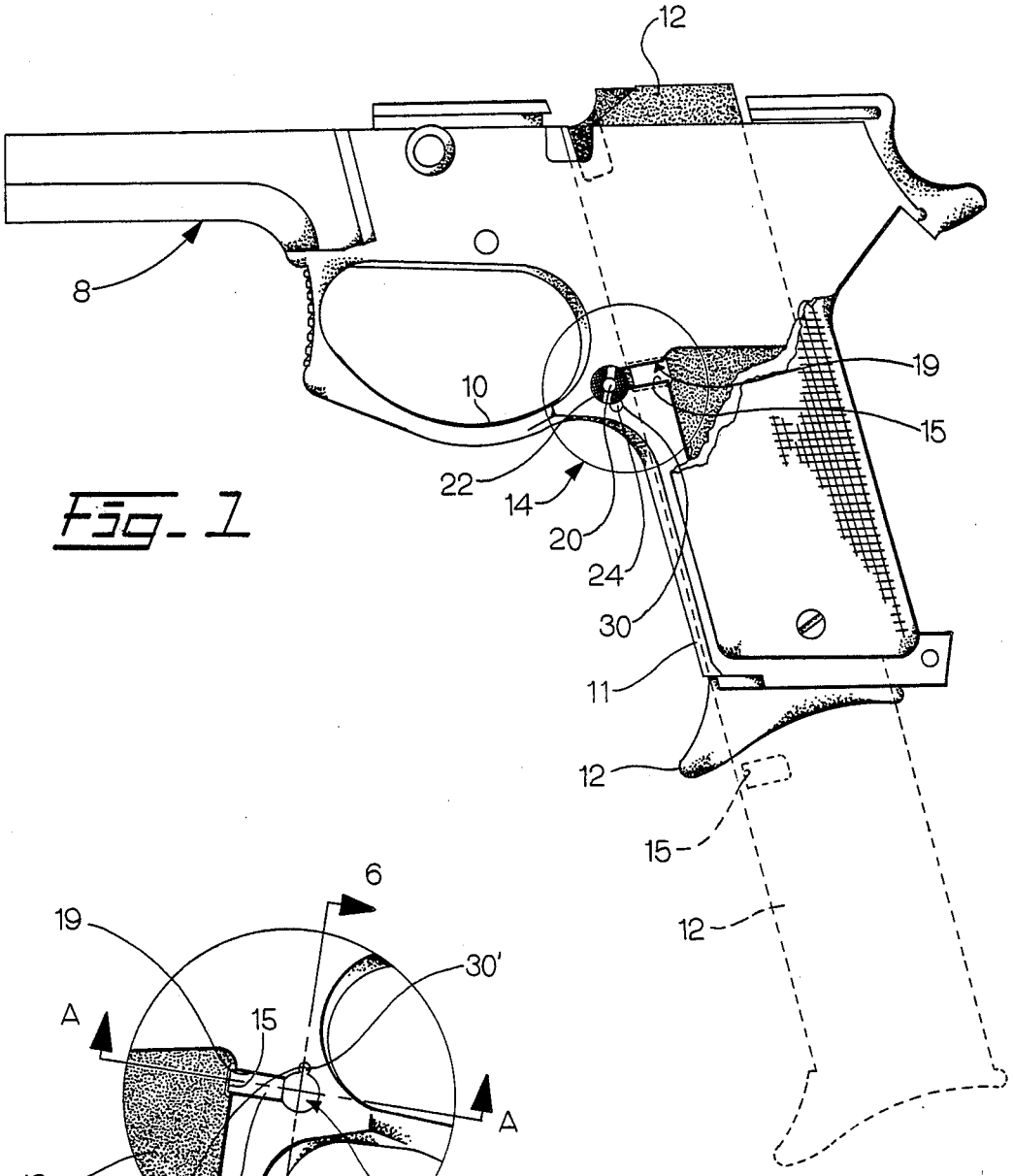
FIG. 1 is a left side elevational view of a handgun frame with the grip partially cut-away, incorporating the magazine catch mechanism of the present invention.

Referring to the details of the drawings, in FIG. 1 is shown the left side of a handgun frame 8 which is fitted with a cartridge clip or magazine 12 shown in "locked" position within the opening in the handle portion 11 of the handgun frame. The cartridge magazine is releasably retained within the handle portion of the handgun by a magazine catch and release mechanism indicated generally at 14 located adjacent the rear portion of the trigger guard 10.

Figure 3:
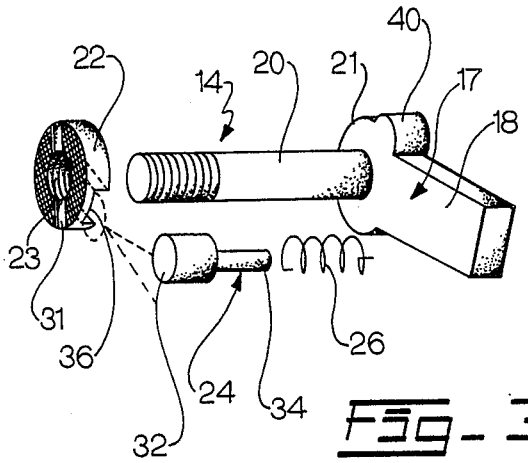
FIG. 3 is an exploded view of the catch mechanism removed from the handgun frame.

As best illustrated in FIG. 3, the catch mechanism 14 comprises a rod or shaft 20 with a large head portion 17 disposed at one end thereof and a nut or actuator button 22 screw-fitted onto a threaded end portion of the rod 20, opposite head portion 17. The head portion 17 of the catch mechanism includes a generally cylindrical hub portion 21, a radially extending arm portion 18 and a semi-cylindrical tab 40 which extends from the circular portion 21 at about 90° from the radial direction of the arm 18. The semi-cylindrical tab 40 is adapted to cover over or close the detent socket 30 or 30', (FIG. 6) whichever is not being used at the time and, thus, serves as a "dust cover" and to provide a finished look to the frame of the gun.

The nut or actuator button 22 has a diameter approximately equal to that of hub 21 and includes a centrally threaded hole 23 adapted to be screw-fitted onto the threads of the shaft 20, a knurled outer edge, a transverse outer slot 31 to receive the blade of a screwdriver or a coin, and a transverse cutout 36 which extends across the underside of the nut 22. The rod 20 is fitted into a bore 28 (FIGS. 4 and 5) for axial movement therein. The bore 28 extends through the frame and opens on both sides thereof.

Figure 5:
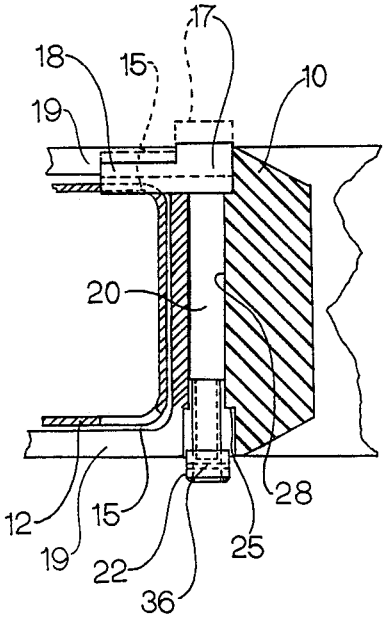
FIG. 5 is a bottom plan view which is similar to FIG. 4, except with the catch mechanism reoriented for a right-handed shooter.
Figure 6:
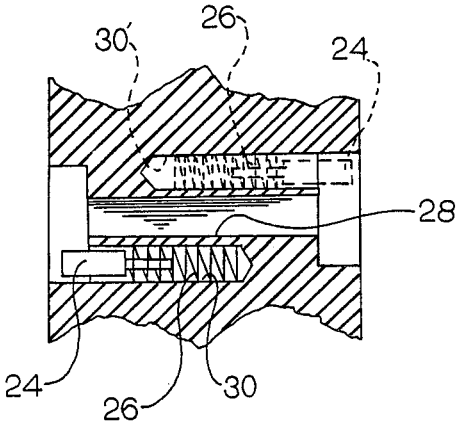
FIG. 6 is a view taken along lines 6—6 of FIG. 2, with parts omitted to illustrate the reversibility of the detent and coil spring of the catch mechanism.

A detent comprising a cylindrically-steppped pin 24 and a coil-spring 26 serves to urge the catch mechanism toward its latched position with its latched arm 18 engaged with one or the other of two cutouts or notches 15 (FIGS. 1 and 5) provided on opposite side edges of the magazine 12. The detent includes a pin having a smaller diameter shank portion 34 adapted to fit within the turns or coils of the spring 26 and an enlarged head portion having a diameter which is adapted to fit into the slot 36 on the underside of the nut 22 which prevents unintentional rotation of the nut. The inter-relationship of the detent 24 and the coil spring 26 when disposed within the socket 30 or 30' is best shown in FIG. 6. The spring serves to bias the detent 24 against the actuator button recess 36 with the button disposed on either side of the handgun frame. The spring 26 has two functions; first, it urges the latch arm 18 into engagement with the magazine notch 15, and second, by urging the detent 24 into the slot 36 in the underside of the actuator nut 22, the nut will be prevented from unscrewing without intentionally depressing the detent out of the slot 36.

Figure 2:
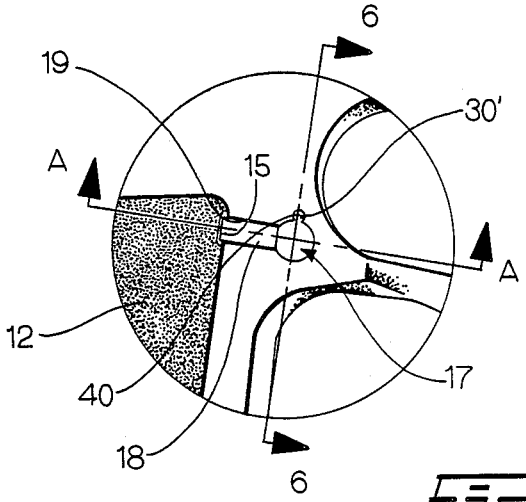
FIG. 2 is an enlarged right side elevational view corresponding to the encircled portion in FIG. 1, displaying the opposite end of the frame and catch mechanism.

The frame 8 is provided with a cutout or slot 19 and a circular recess 25 (FIG. 5) disposed on each side thereof of a shape and size to accommodate the rectangular latch arm portion 18 of the catch mechanism 14, the circular hub portion 21 and tab portion 40. As best illustrated in FIGS. 1 and 2, the portion of cutout 19 adapted for receiving tab 40 extends from the bottom of the circular recess on the left side of the frame and from the top thereof on the right side. This permits reversability of the catch mechanism. Detent receiving sockets 30 and 30' (FIG. 6) are located adjacent to and parallel to bore 28 adapted to receive the shaft 20 of the catch mechanism. Socket 30 is located below bore 28 and opens toward the left side of the frame, while socket 30' is located above the bore 28 and opens toward the right side of the frame. This arrangement permits quick and simple reversal of the catch mechanism and detent means from one side to the other of the handgun frame, as will hereinafter be more fully described.

Figure 4:
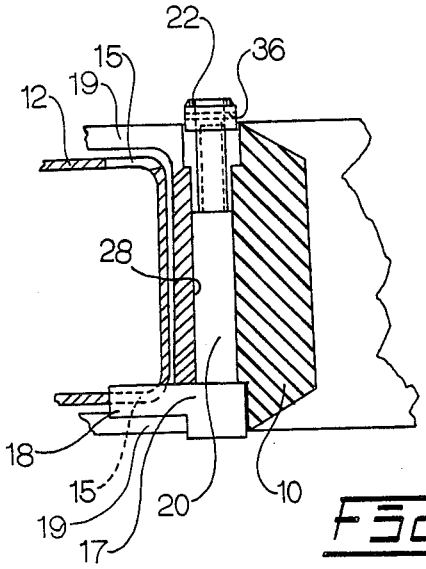
FIG. 4 is a bottom plan view taken along section line A—A of FIG. 2 with the mechanism oriented for a left-handed shooter.

The catch mechanism is shown in its assembled condition in FIG. 1 with the actuator nut or button 22 thereof disposed in the left side of the handgun frame whereby the catch mechanism is positioned for operation by right-handed shooters. The opposite side of the frame is depicted in FIG. 2 in which arm 18 is engaged with notch 15 in the right side of the magazine 12. In FIGS. 4 and 5, the catch mechanism is shown as it would appear on different sides of the frame adapted to be used by left and right-handed shooters.

The catch mechanism 14 is assembled into the frame by first inserting the spring 26 and detent 24 in either socket 30 or 30', inserting of the shaft 20, screw-end first, into the bore 28 until the enlarged portion of the catch arm, including the arm 18, is disposed in the correspondingly shaped slot 19 on the right or left side of the frame, depending upon the shooter's choice. In either case, the detent should be located on the same side of the frame as the actuator nut 22. The head of the pin 24 will then be depressed and nut 22 is then screw-fitted securely onto the threaded portion of the shaft 20 until the catch mechanism is properly tensioned within the cutout 19 of the frame. As previously mentioned, the detent pin 24 and spring 26 serve two purposes, i.e., to tension the catch mechanism toward its magazine engaging position and to prevent unintentional removal of the actuator button 22 from the shaft.

To reverse the magazine catch mechanism from one side to the other of the frame 8, the detent 24 must first be depressed out of engagement with the actuator button recess 36. This may be done with any available pointed implement such as a pencil point, pin, paper clip or the like. The actuator button may then be unscrewed from the end of rod 20 which can then be removed from the bore 28. The detent 24 and spring 26 are then removed from one detent socket 30 and inserted into socket 30'. Rod 20 is next fitted into bore 28 from the opposite side of the frame 8 and, while the detent spring 26 is compressed, the knurled actuator nut 22 is screwed onto the threaded end of the rod 20 until the upper surface of nut 22 is approximately flush with the end of the rod 20. Finally, the detent is released whereby spring 26 will urge the head 52 of detent 24 into engagement with slot 36.

The catch mechanism is operated by simply depressing nut 22 against the spring-pressure of detent 24 whereby rod 20 is moved laterally in bore 28 until the nut 22 contacts circular recess 25 and arm 18 clears magazine notch 15 (FIG. 5). As a result, the magazine will be released and ejected from magazine housing or recess in the handle of frame 8 by action of a magazine spring (not shown) which urges the magazine downwardly from its housing.

Having thus described my invention, what is claimed is:

1. A reversible magazine catch for a semi-automatic handgun having a frame with a downwardly opening cavity adapted to receive therein a cartridge holding magazine, a notch on each side of said magazine, a bore extending through said frame and opening on opposite sides thereof, sockets disposed adjacent said bore and opening outwardly toward opposite sides of the frame, each side of said frame having a cutout communicating with the bore and each of said sockets, said magazine catch comprising a rod with an arm at one end thereof adapted to engage each of said notches in said magazine, said rod having a threaded end and a nut removably screw-fitted thereon, a detent and spring adapted to be received in each of said sockets to urge said arm selectively into engagement with each of said notches whereby said magazine catch is reversible upon removing said nut from the rod and reversing the rod from one end to the other of said frame.

2. Reversible magazine catch, as set forth in claim 1, in which said detent is interchangeable from one to the other of said sockets and engages the underside of said nut to serve as a spring tensioning means for the operation of said catch mechanism.

3. Reversible magazine catch, as set forth in claim 2, in which said nut includes a slot in the underside thereof for receiving the detent to prevent the unscrewing of said nut from the threaded portion of said rod.

4. Reversible magazine catch, as set forth in claim 3, in which the arm portion of said magazine catch extends from a generally circular hub portion.

5. Reversible magazine catch, as set forth in claim 4, in which a semi-circular tab extends from said circular hub portion of said arm and is located to cover each of the openings formed by the one of said detent sockets within said frame not then in use.

* * * * *